US009816311B2

(12) United States Patent
Reyes

(10) Patent No.: US 9,816,311 B2
(45) Date of Patent: Nov. 14, 2017

(54) PORTABLE BARRIER FOR A DOOR SILL

(71) Applicant: Eutimio Reyes, Homestead, FL (US)

(72) Inventor: Eutimio Reyes, Homestead, FL (US)

( * ) Notice: Subject to any disclaimer, the term of this patent is extended or adjusted under 35 U.S.C. 154(b) by 0 days.

(21) Appl. No.: 14/802,212

(22) Filed: Jul. 17, 2015

(65) Prior Publication Data

US 2017/0016268 A1 Jan. 19, 2017

(51) Int. Cl.
*E06B 1/70* (2006.01)

(52) U.S. Cl.
CPC ..... *E06B 1/70* (2013.01)

(58) Field of Classification Search
CPC ..... E06B 1/70
USPC ..... 49/467, 468, 469
See application file for complete search history.

(56) References Cited

U.S. PATENT DOCUMENTS 2,818,614 A * 1/1958 Lapka, Jr. ..... E06B 1/70 49/469
3,123,870 A * 3/1964 Coe ..... E06B 7/18 49/304
3,796,985 A * 3/1974 Weber ..... H05K 7/1412 439/359
5,010,690 A * 4/1991 Geoffrey ..... E06B 1/70 49/468
5,029,911 A * 7/1991 Daniels ..... E05B 63/0052 292/170
5,581,949 A * 12/1996 Wu ..... E06B 1/70 49/467
7,066,102 B1 * 6/2006 Tossavainen ..... B63B 21/00 114/230.1
2005/0210754 A1 * 9/2005 Ferrell ..... E06B 7/22 49/468
2011/0265386 A1 * 11/2011 Dunstan ..... E06B 1/70 49/468
2012/0085037 A1 * 4/2012 Van Camp ..... E06B 1/70 49/468
2013/0047518 A1 * 2/2013 Van Camp ..... E06B 1/70 49/468
2016/0145931 A1 * 5/2016 Meeks ..... E06B 1/70 49/468

* cited by examiner

*Primary Examiner* — Gregory Strimbu
(74) *Attorney, Agent, or Firm* — ruben alcoba, esq.

(57) ABSTRACT

A portable barrier for a door sill that comprises of a restriction bar, a mount bar that is disposed on the restriction bar, a connection tube that joins the restriction bar with the mount bar, and an adjustable spring mechanism that allows the mount bar to be adjusted upward or downward. The adjustable mechanism comprises springs and screws that can be manually adjusted.

15 Claims, 7 Drawing Sheets

PORTABLE BARRIER FOR A DOOR SILL

BACKGROUND

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The present invention is directed to a portable barrier for a door sill that fills a gap between the flooring and the bottom of a respective door to inhibit passage of water, air, and pests through the gap and onto the flooring inside the respective building.

The inventor noticed that often, water, air, and pests would pass beneath the threshold of the door, even when the door was closed. The inventor realized that this was often an undesirable invitation to damage to the floor and interior of the building.

The inventor realized that with increasing heating costs, it was becoming more and more important to reduce as much as possible the infiltration of air through doors and windows. The inventor quickly saw that the major sources of air infiltration is through the bottom of the doors of dwellings. The inventor decided that the threshold should provide a good thermal barrier in order to prevent condensation and icing on the portion of the threshold within the building interior. Additionally, the inventor knew that flooding from outside the building would seep through the door, and thereby cause damage to the carpet and furniture inside. And finally, the inventor knew that ants, termites, cockroaches, and even small mice could squeeze between the door sill and the bottom of the door.

Through additional research, the inventor learned that since thresholds are installed in door openings, they are disposed in high pedestrian traffic area of the respective building and subjected to substantial stresses as people often step on the respective threshold. Often such pedestrian traffic can cause the cantilevered toe portion to bend downward, thereby deforming the respective door sill. Furthermore, although known thresholds generally prevent rain water from passing though the gap between the bottom of the door and the flooring onto the flooring inside the respective building, known door sills often allow rain water to flow under the threshold itself The inventor decided that an additional barrier had to be combined with the traditional door sill to provide greater protection against water, air, and pests. The inventor noted that, generally all exterior door openings, or doorways, include a threshold, commonly referred to as a door threshold. Such door thresholds generally provide a transition between the exterior building structure and the flooring inside the respective door opening, and provide a means for preventing water and air from easily passing between the bottom of a door hung in the respective door opening and the respective flooring.

The inventor decided to install a barrier in the space that forms in the door sill, between the heel and toe portions. This fixed barrier that the inventor attached did well to prevent the water, air, and pests from entering through the threshold. However, when a wheeled vehicle needed to pass over the barrier, it was restricted from doing so and had to be lifted.

Through trial and error, the inventor learned that a spring could be combined with the barrier. The spring occupied a space that enabled the barrier to remain extended to block the passageway beneath the door, yet also enabled the barrier to compress into the door sill when a wheeled vehicle passed through. However, after noticing the wheeled vehicle could not always clear the barrier easily, the inventor made one of the edges tapered, so that the wheel could more easily roll over the barrier.

The inventor realized that the barrier could have more uses to work with variously sized door sills and thresholds if it was portable and height adjustable. The inventor added a bolt that detachably anchored the barrier into the floor. The bolt also adjusted the height of the barrier in the natural extended position.

For the foregoing reasons, there is a portable barrier for a door sill that fills a gap between the flooring and the bottom of a respective door to inhibit passage of water, air, and pests through the gap and onto the flooring inside the respective building.

Delivery systems and methods have been utilized in the past; yet none with the characteristics of the present invention. See U.S. Pat. Nos. 5,010,690; 6,484,446; and 8,966,823.

For the foregoing reasons, there is a need for a portable barrier for a door sill that fills a gap between the flooring and the bottom of a respective door to inhibit passage of water, air, and pests through the gap and onto the flooring inside the respective building.

SUMMARY

The present invention describes a portable barrier for a door sill that fills a gap between the flooring and the bottom of a respective door to inhibit passage of water, air, and pests through the gap and onto the flooring inside the respective building. The portable door sill barrier, hereafter, "barrier", detachably attaches to a door sill that is disposed on an exterior side of the door. The door sill may include a horizontal piece of wood, stone or metal at the threshold of a doorway or doorstep. In one embodiment, the door sill comprises an elongated triangular structure having a top surface, a heel portion, and a toe portion; wherein the top surface is angled and declines in height to form a slope. A space forms between the heel portion and the toe portion of the door sill. The barrier detachably positions inside the space.

The barrier is height adjustable, so as to enable the dual function of inhibiting passage through the gap beneath the door, and enabling passage of a wheeled vehicle over the barrier and through the threshold of the door. The barrier utilizes a spring-tensioned mechanism that biases towards an extended position for expanding the barrier above the space in the door sill, and thereby inhibiting passage through the threshold of the door. In this manner, the door sill inhibits passage up to a first height; and the barrier, in essence, extends the height capacity of the door sill by filling the gap beneath the floor and the door. In addition to the extended position, the spring-tensioned mechanism of the barrier is configured to compress flush with the top surface of the door sill when a pressure is applied thereon. The pressure that is exerted on the barrier may include a wheel from a vehicle that presses down on the barrier as it passes through the threshold of the door. The barrier is tapered at the top surface, so as to help the wheel smoothly pass over the barrier.

In some embodiments, the barrier may include a restriction bar having at least one tapered edge and at least one aperture. The restriction bar is configured to provide the chief restriction against water, air, and pests above the door sill. The barrier may further include a mount bar. The mount bar comprises at least one mount hole. The mount bar is rests in a parallel, spaced-apart relationship to the restriction bar. The mount bar enables the barrier to be anchored to the floor. The restriction bar moves in relation to the anchored mount bar.

The barrier further comprises a connecting tube that joins the restriction bar with the mount bar. The connecting tube is disposed in alignment with the at least one aperture and the at least one mount hole. The barrier further includes a mounting tube. The mounting tube includes a threaded inner surface and a cavity. The mounting tube remains in alignment with the connecting tube and the at least one mount hole. The mounting tube extend from the mount bar, towards the floor. The mounting tube may penetrate the floor for anchoring the barrier.

In some embodiments, the barrier may further include a bolt. The bolt has a head end and a mount end. The mount end may include threads that are configured to rotatably engage the threaded inner surface of the mounting tube. The bolt is configured to pass through the at least one aperture, the connecting tube, the at least one mount hole, and the mounting tube. In this manner, the bolt may be displaced cross-length to the barrier, passing through the connecting tube and the mounting tube. The threaded interaction between the threads of the bolt and the threaded inner surface of the mounting tube enables the bolt to rotate in a first direction. This works to urge the restriction bar towards the mount bar. Conversely, the bolt can be rotated in a second direction to urge the restriction bar away from the mount bar. In this manner, the restriction bar can be fixed at a desired height while in the natural extended position.

The barrier further comprises a spring that displaces the restriction barrier above the top surface of the door sill from a natural position. The spring may also be forcibly compressed to enable the restriction barrier to move towards the mount barrier, towards the mount bar. The spring is disposed between the bolt and the mounting tube. The spring rests in the cavity that forms inside the mount tube. Specifically, the spring wraps around the bolt.

The spring is configured to position in a natural extended position from around the bolt. The extended position of the spring urges the restriction bar away from the mount bar, as the tension of the spring presses against the restriction bar. The spring is further configured to be urged into a compressed position by applying a downward force on the restriction bar. The compressed position of the spring enables the restriction bar to be displaced towards the mount bar. In this manner, the restriction bar remains extended to serve as a barrier against water, air, and pests; yet the weight of a wheeled vehicle can press the restriction bar into the space formed by the door sill so for passing over the barrier and through the threshold of the door.

One objective of the present invention is to prevent water, air, and pests from penetrating a joint formed between a bottom of the threshold and a floor structure to which the threshold is mounted.

Another objective of the present invention is to provide a portable barrier that mounts into a door sill, yet can be easily unmounted for portability to a different door sill.

Another objective of the present invention is to enable a wheeled vehicle to roll over the barrier.

Yet another objective of the present invention is to provide a portable barrier that adjusts to fit different door sills.

Yet another objective is to provide a portable barrier that is height adjustable for restricting passage through variously sized gaps between the threshold and the door.

Yet another objective is to provide a bolt that retains the restriction bar at a fixed distance from the mount bar.

Yet another objective is to provide a portable barrier that is inexpensive to manufacture and adaptable to variously sized door sills.

DRAWINGS

These and other features, aspects, and advantages of the present invention will become better understood with regard to the following description, appended claims, and drawings where:

FIGS. 1A, 1B, and 1C are perspective views of an exemplary portable barrier moving from an extended position to a compressed position relative to an exemplary door sill, where FIG. 1A shows a perspective exploded view of an exemplary portable barrier, FIG. 1B shows a perspective view of the portable barrier shown in FIG. 1A with an exemplary restriction bar detached from an exemplary mount bar; and FIG. 1C shows a perspective view of the portable barrier shown in FIG. 1A with the restriction bar engaged with the mount bar;

FIG. 2A shows the extended position, and FIG. 2B shows the compressed position;

FIG. 3A shows an exemplary spring in the extended position, and FIG. 3B shows the spring in the compressed position;

Figure 4A:
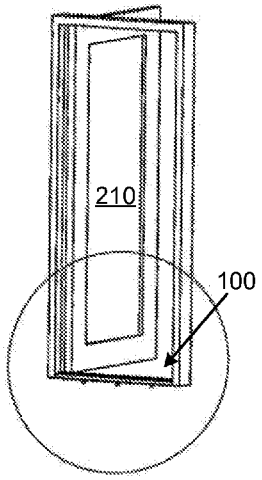
Figure 4B:
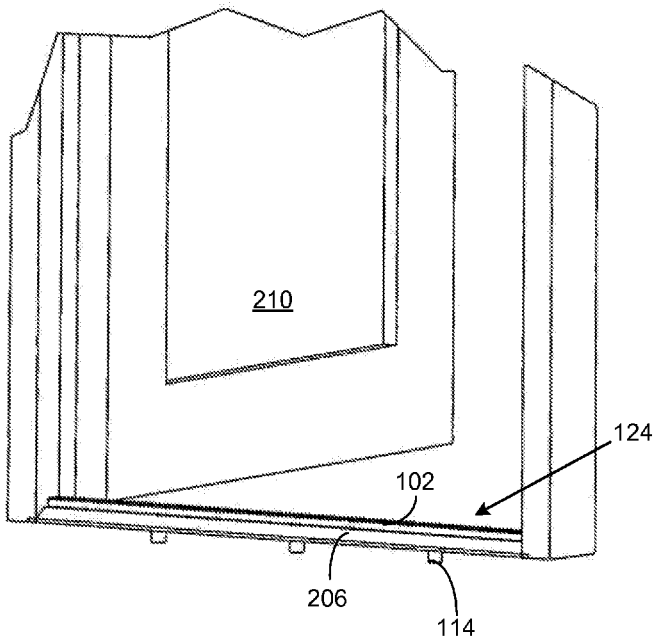
Figure 5A:
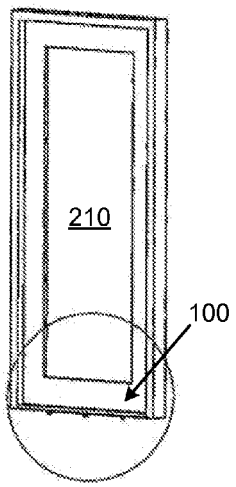
Figure 5B:
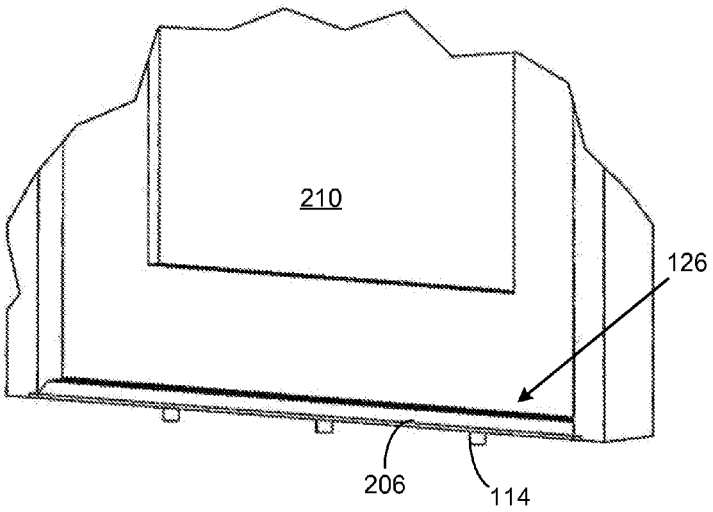

FIGS. 4A and 4B are perspective views of the portable barrier extended from the door sill in front of an open threshold of a door, where FIG. 4A shows the door opened, and FIG. 4B shows a close up of the sill in relation to the opened door; and FIGS. 5A and 5B are perspective views of the portable barrier compressed into the door sill in front of a closed threshold of a door, where FIG. 5A shows the door closed, and FIG. 5B shows a close up of the sill in relation to the closed door.

DESCRIPTION

The present invention is directed to a portable barrier 100 for a door sill 200 that fills a gap between the flooring and the bottom of a respective door 210 to inhibit passage of water, air, and pests through the gap and onto the flooring inside the respective building. The portable barrier 100, hereafter, "barrier 100", is portable to be operational with variously sized and dimensioned door sills 200. The barrier 100 may be used with different styles and sizes of doors 210 to restrict passage through the gap that forms beneath the door 210 at the threshold.

The barrier 100 detachably attaches to a door sill 200 that rests on an exterior side of the door 210. The door sill 200 may include a horizontal piece of wood, stone or metal at the threshold of a doorway or doorstep. In one embodiment, the door sill 200 comprises an elongated triangular structure having a top surface 202, a heel portion 206, and a toe portion 204; wherein the top surface 202 is angled and declines in height to form a slope. A space 208 is disposed between the heel portion 206 and the toe portion 202 of the door sill 200. In one embodiment, the barrier 100 detachably positions inside the space 208, extending along the length of the door sill 200.

The barrier 100 detachably attaches to a door sill 200 that rests on an exterior side of the door 210. The door sill 200 may include a horizontal piece of wood, stone or metal at the threshold of a doorway or doorstep. In one embodiment, the door sill 200 comprises an elongated triangular structure having a top surface 202, a heel portion 206, and a toe portion 204; wherein the top surface 202 is angled and declines in height to form a slope. A space 208 forms between the heel portion 206 and the toe portion 204 of the door sill 200. In one embodiment, the barrier 100 detachably positions inside the space 208, extending along the length of the door sill 200.

Figure 1A:
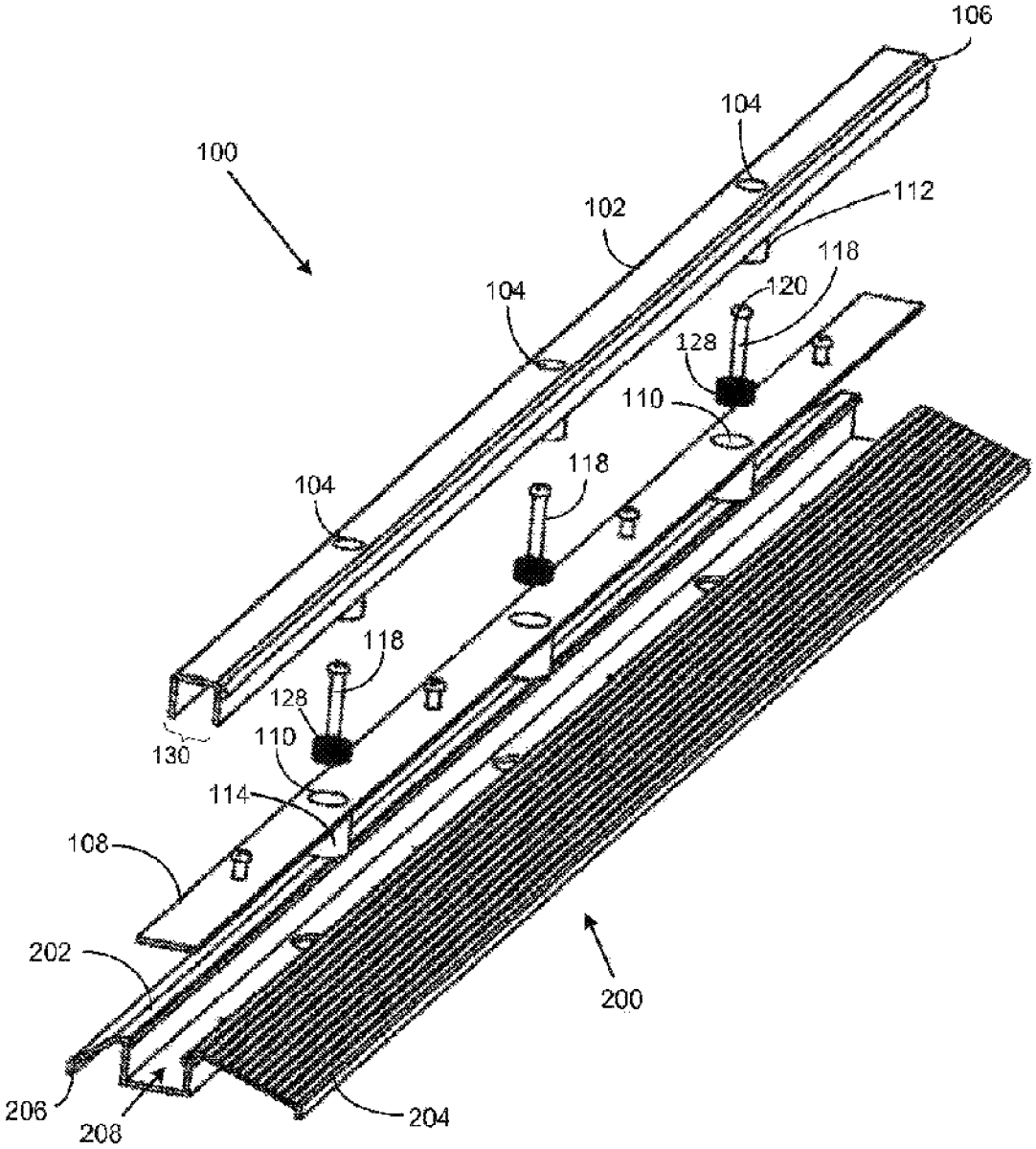
Figure 1B:
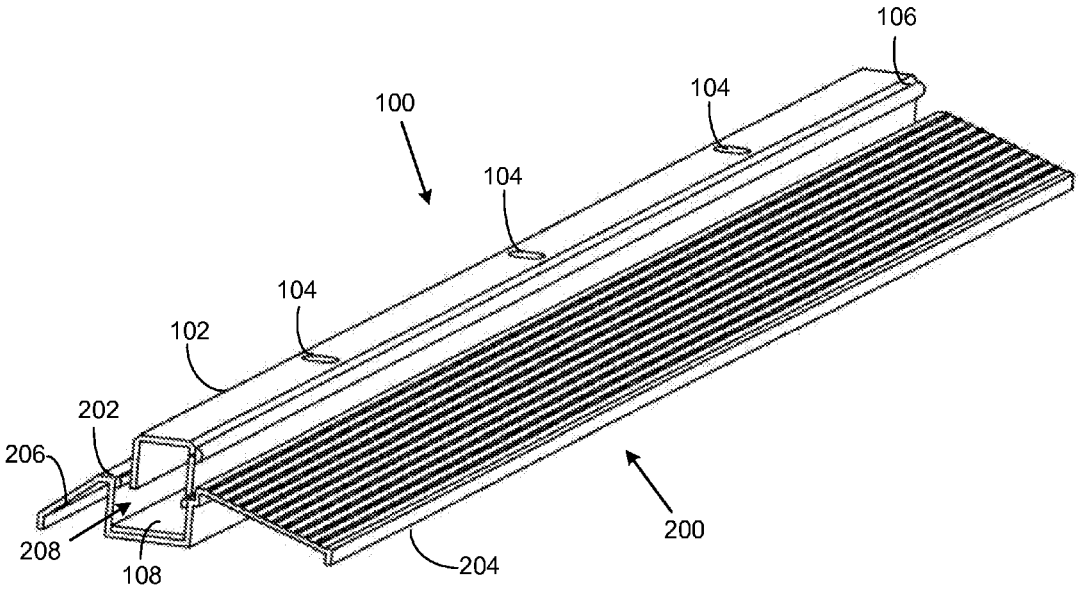
Figure 1C:
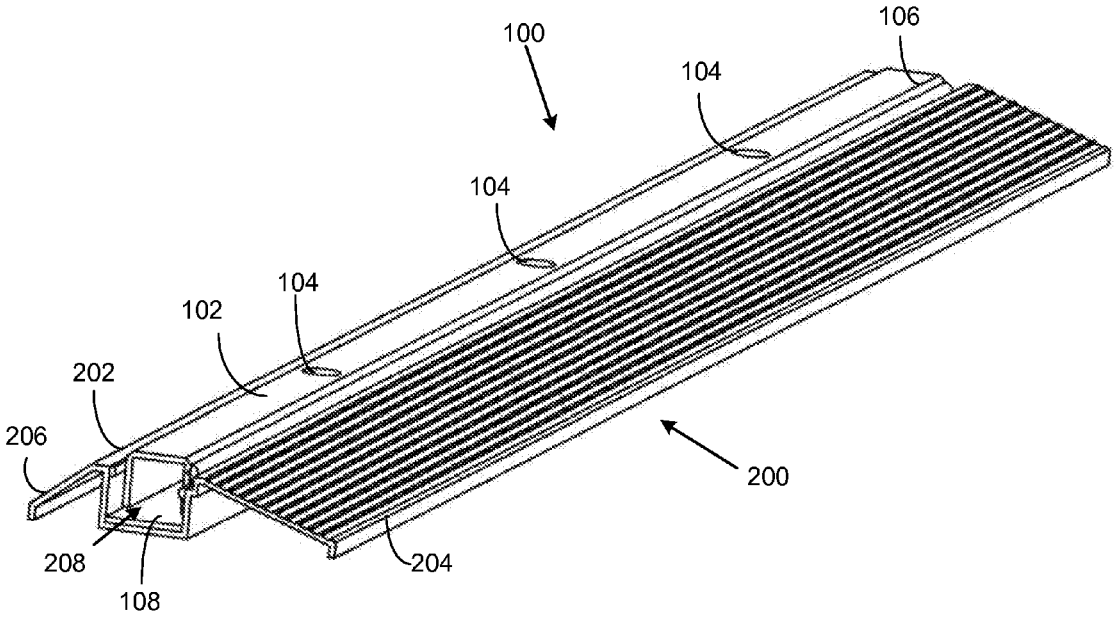
Figure 2A:
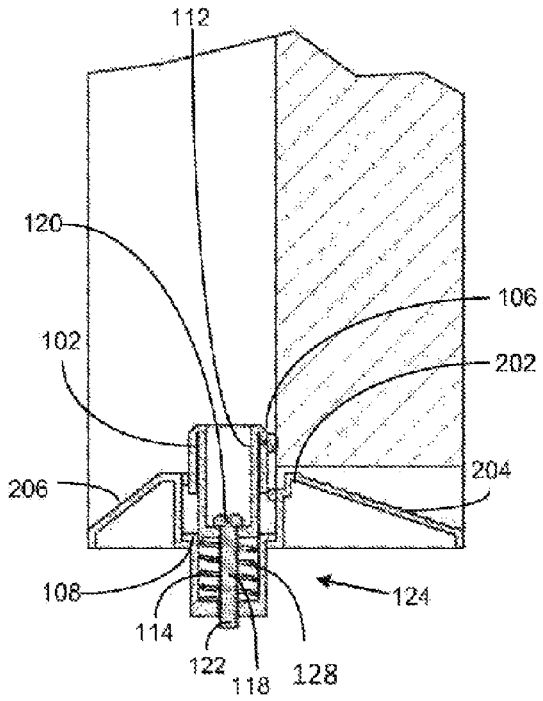
FIGS. 2A and 2B are sectioned side views of the portable barrier extended and compressed into door sill, where
Figure 2B:
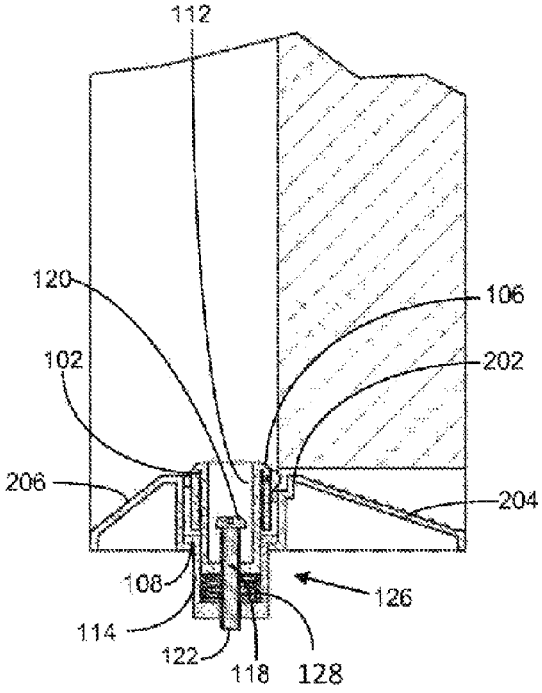

Looking now at FIGS. 1B and 1C, in addition to the extended position 124, the spring 116 is configured to compress, so that the barrier 100 remains flush with the top surface 202 of the door sill 200 when a pressure is applied thereon, as shown in FIGS. 2A and 2B. The pressure that is exerted on the barrier 100 may include a wheel from a vehicle that presses down on the barrier 100 as it passes through the threshold of the door 210. Though, any mobile object may easily pass over the barrier 100. The barrier 100 is tapered at the top surface 202, so as to help the wheel smoothly pass over the barrier 100.

Figure 3A:
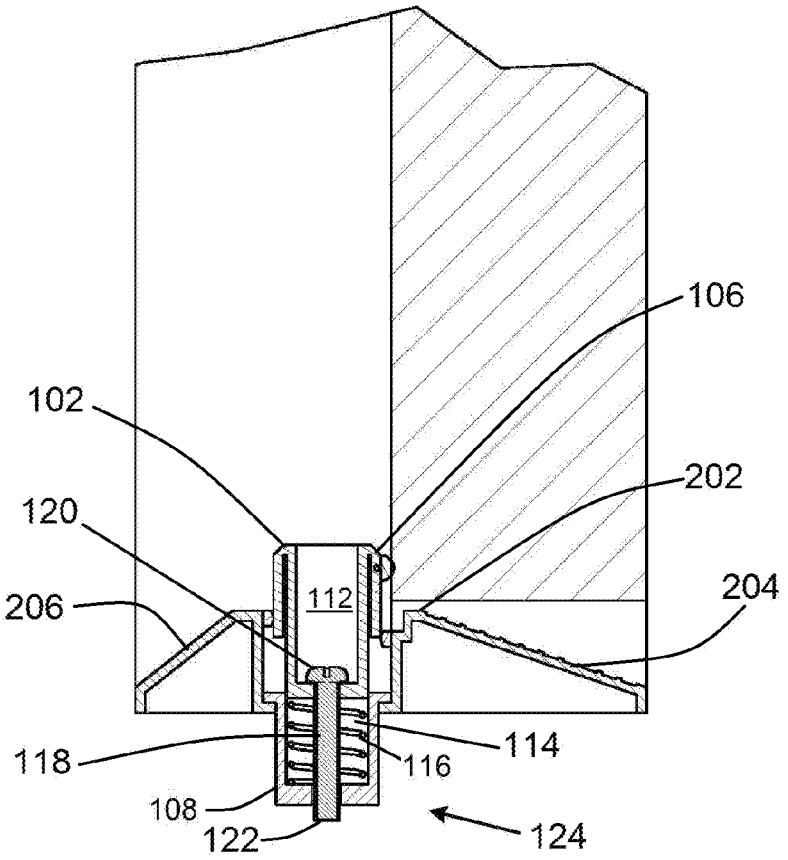
FIGS. 3A and 3B are close up sectioned views of the portable barrier extended and compressed into door sill, where

Turning now to FIG. 3A, the barrier 100 may include a restriction bar 102. The restriction bar 102 is configured to provide the chief blockage against water, air, and pests between the door 210 and the door sill 200. The restriction bar 102 is elongated and has a generally cubicle cross section, so as to fit into the space of the door sill 200. The restriction bar 102 may include at least one aperture 104. Two apertures are sized and dimensioned to receive a threaded member and are formed on the restriction bar 102.

Figure 3B:
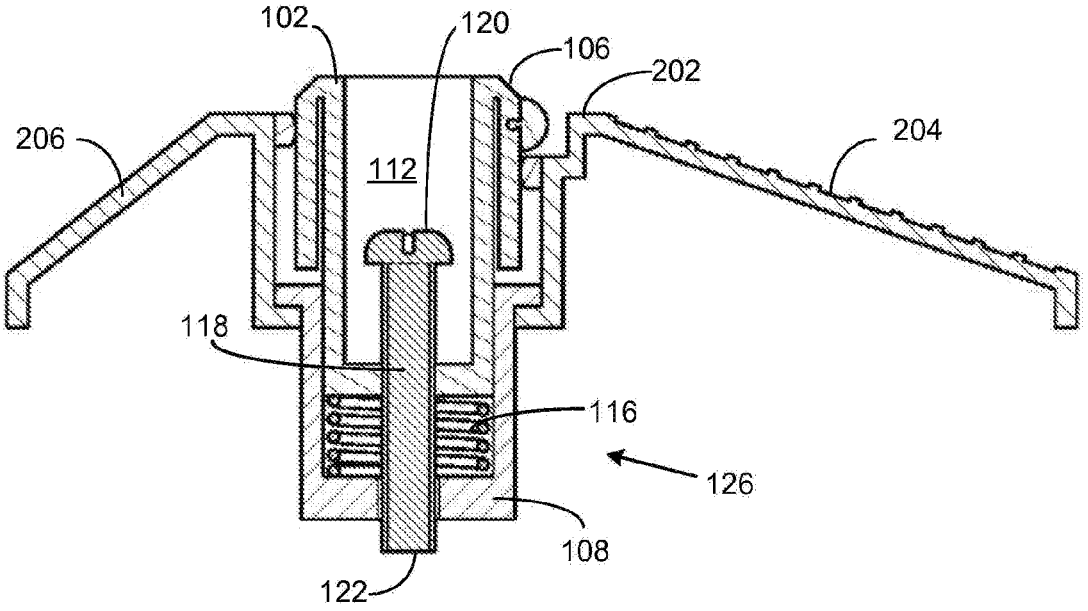

As shown in FIG. 3B, the restriction bar 102 may include at least one tapered edge 106. The tapered edge 106 is configured to enable a wheel to cross the barrier 100. Those skilled in the art will recognize that a tapered edge 106 forms a fulcrum that provides leverage for a wheel to more easily roll over the restriction bar 102. Suitable materials for the restriction bar 102 may include, without limitation, metal, wood, and a rigid polymer.

The barrier 100 may further include a mount bar 108. The mount bar 108 is rests in a parallel, spaced-apart relationship to the restriction bar 102. The mount bar 108 is elongated and is generally flat. The mount bar 108 enables the barrier 100 to be anchored to the floor. The restriction bar 102 moves in relation to the anchored mount bar 108. The mount bar 108 comprises at least one mount hole 110. In one embodiment, two mount holes 110 that are sized and dimensioned to receive the bolt 118 pass through the mount bar 108. Suitable materials for the mount bar 108 may include, without limitation, metal, wood, and a rigid polymer.

Looking back at FIG. 1A, the barrier 100 comprises a connecting tube 112 that joins the restriction bar 102 with the mount bar 108. The connecting tube 112 is disposed in alignment with the at least one aperture 104 and the at least one mount hole 110. The connecting tube 112 ensures that the restriction bar 102 and the mount bar 108 remain aligned.

The barrier 100 further includes a mounting tube 114. The mounting tube 114 includes a threaded inner surface and a cavity. The mounting tube 114 remains in alignment with the connecting tube 112 and the at least one mount hole 110. The mounting tube 114 extends from the mount bar 108, and towards the floor. The mounting tube 114 may penetrate the floor to enable the barrier to be anchored into the floor from the space 208 in the door sill 200. In one embodiment, multiple mounting tubes extend in a spaced-apart relationship across the mount bar 108.

In some embodiments, the barrier 100 may further include a bolt 118. The bolt serves to tie the components of the barrier 100 together. The bolt 118 also penetrates the floor for detachably anchoring the barrier 100 into the door sill 200. The bolt 118 has a head end 120 and a mount end 122. The head end 120 may include a slot for receiving a screwdriver. A washer (not shown) may be positioned between the head end 120 of the bolt 118 and the connecting tube 112. The mount end 122 of the bolt 118 may include threads that are configured to rotatably engage the threaded inner surface of the mounting tube 114. The bolt 118 may include, without limitation, a screw, a through bolt 118, and an anchor bolt 118.

The bolt 118 is configured to pass through the at least one aperture 104, the connecting tube 112, the at least one mount hole 110, and the mounting tube 114. In this manner, the bolt 118 may be displaced cross-length to the barrier 100, passing through the connecting tube 112 and the mounting tube 114. The threaded interaction between the threads of the bolt 118 and the threaded inner surface of the mounting tube 114 enables the bolt 118 to rotate in a first direction. This works to urge the restriction bar 102 towards the mount bar 108. The first direction may include a clockwise direction. Conversely, the bolt 118 can be rotated in a second direction to urge the restriction bar 102 away from the mount bar 108. The second direction may include a counterclockwise direction. In this manner, the natural height of the restriction bar 102 can be adjusted, depending on the door sill 200 and the door 210.

The barrier 100 further comprises a spring 116 that displaces the restriction bar 102 above the top surface 202 of the door sill 200 from a natural position. The spring 116 may also be forcibly compressed to enable the restriction bar 102 to move towards the mount bar 108. The spring 116 is disposed between the bolt 118 and the mounting tube 114. The spring 116 rests in the cavity that forms inside the mounting tube 114. Specifically, the spring 116 wraps around the bolt 118, abutting against the sidewalls of the cavity to compress and expand, depending on the forces applied thereon. In one embodiment, the spring 116 is a coil spring that naturally expands, yet is also adapted to be compressed, so as to store energy that can be used to push against the restriction bar 102.

As illustrated in FIG. 4A, the spring 116 is configured to position in a natural extended position 124 while wrapped around the bolt 118. The extended position 124 of the spring 116 urges the restriction bar 102 away from the mount bar 108, as the tension of the spring 116 presses against the restriction bar 102. FIG. 4B shows a close up view of the restriction bar 102 extended in front of an open threshold of a door 210.

Looking now at FIG. 5A, the spring 116 is further configured to be urged into a compressed position 126 by applying a downward force on the restriction bar 102. The force may include the weight of a wheeled vehicle. The compressed position 126 of the spring 116 enables the restriction bar 102 to be displaced towards the mount bar 108.

Because of the spring 116, the restriction bar 102 remains in a natural extended position 124 to block water, air, and pests; yet the spring 116 allows the weight of a wheeled vehicle to press the restriction bar 102 into the space 208 formed by the door sill 200 for passing over the barrier 100 and through the threshold of the door 210. FIG. 5B shows a close up view of the restriction bar 102 compressed into the space 208 of the door sill 200 in front of a closed threshold of a door 210.

While the inventor's above description contains many specificities, these should not be construed as limitations on the scope, but rather as an exemplification of several preferred embodiments thereof. Many other variations are possible. For example, the barrier may be used without a door sill, anchoring directly into the flooring. Accordingly, the scope should be determined not by the embodiments illustrated, but by the appended claims and their legal equivalents.

What is claimed is:

1. A portable barrier for filling a gap between a floor and a bottom of a door, the barrier comprises:

a restriction bar, the restriction bar comprising at least one tapered edge and at least one aperture;

a mount bar, the mount bar comprising at least one mount hole, the mount bar disposed in a parallel, spaced-apart relationship to the restriction bar;

a connecting tube, the connecting tube configured to join the restriction bar with the mount bar, the connecting tube disposed in alignment with the at least one aperture and the at least one mount hole;

a mounting tube, the mounting tube comprising a threaded inner surface, the mounting tube disposed in alignment with the connecting tube, the at least one mount hole and the at least one aperture, the mounting tube configured to extend from the mount bar;

a bolt, the bolt comprising a head end and a mount end, the mount end having threads configured to rotatably engage the threaded inner surface of the mounting tube, the bolt configured to be displaced along a length of the connecting tube and a length of the mounting tube, wherein rotation of the bolt in a first direction urges the restriction bar towards the mount bar, wherein rotation of the bolt in a second direction enables the restriction bar to move away from the mount bar; and a spring, the spring disposed between the connecting tube and the mounting tube, wherein when the spring is compressed, the spring urges the restriction bar away from the mount bar.

2. The barrier of claim 1, wherein the at least one tapered edge of the restriction bar is configured to enable a wheel to roll over the barrier.

3. The barrier of claim 1, wherein the barrier is configured to detachably engage a door sill.

4. The barrier of claim 3, wherein the barrier is configured to be disposed within the door sill.

5. The barrier of claim 4, wherein the mount end of the bolt is configured to penetrate the floor for anchoring the barrier to the floor.

6. The barrier of claim 1, wherein the mount bar is elongated and generally flat.

7. The barrier of claim 1, wherein the mount tube has a cavity.

8. The barrier of claim 7, wherein the spring is disposed in the cavity.

9. The barrier of claim 1, wherein a diameter of the connecting tube is smaller than a diameter of the mounting tube.

10. The barrier of claim 1, wherein the spring is disposed around the bolt.

11. The barrier of claim 1, wherein the first direction is clockwise.

12. The barrier of claim 1, wherein the second direction is counterclockwise.

13. The barrier of claim 1, wherein the spring is a coil spring.

14. The barrier of claim 1, wherein the at least one aperture is two apertures.

15. The barrier of claim 1, wherein the at least one mount hole is two mount holes.

* * * * *